US005782154A

United States Patent [19]

Hansen

[11] Patent Number: 5,782,154

[45] Date of Patent: Jul. 21, 1998

[54] NAIL STICK TRIMMER

[76] Inventor: Judy M. Hansen, 346 Eastwood Ter., Boca Raton, Fla. 33431

[21] Appl. No.: 779,792

[22] Filed: Jan. 7, 1997

[51] Int. Cl.[6] ..... B26D 7/00

[52] U.S. Cl. ..... 83/167; 83/581; 83/944

[58] Field of Search ..... 83/944, 167, 588, 83/563, 581; 30/109

[56] References Cited

U.S. PATENT DOCUMENTS

| | | | |
|---|---|---|---|
| 187,641 | 2/1877 | Kast | 30/109 |
| 2,521,854 | 9/1950 | King | 30/109 |
| 2,730,811 | 1/1956 | Gouldsmith, Jr. | 83/588 X |
| 4,928,424 | 5/1990 | Campanelli et al. | 83/167 X |

*Primary Examiner*—Maurina T. Rachuba
*Attorney, Agent, or Firm*—Robert M. Downey, P.A.

[57] ABSTRACT

A nail stick trimmer is shown having a base, and a vertical tower for supporting a nail stick and for trimming off a used portion of the nail stick. The vertical tower includes a support portion that is fixed to the base of the nail stick trimmer and a separate clamping portion that is removably attached to the support portion. A surface of the support portion of the vertical tower defines an angled recess that has dimensions for cradling the nail stick against the support portion. The clamping portion of the vertical tower mates with the support portion in order to hold the nail stick in the angled recess during a trimming process. A blade carrier is slidably supported on an outer periphery of the support portion and a blade supported within the blade carrier travels along a cutting plane as the blade carrier is moved relative to the vertical tower. A nail stick to be processed for reuse is placed within the recess through the vertical tower with a used end portion of the nail stick extending beyond the cutting plane. The used end portions of the nail stick are trimmed off by downward movement of the blade carrier relative to the vertical tower. A biasing device is also provided for returning the blade carrier to an upward resting position after downward movement of the blade carrier has resulted in trimming of the used end portion of a nail stick.

4 Claims, 2 Drawing Sheets

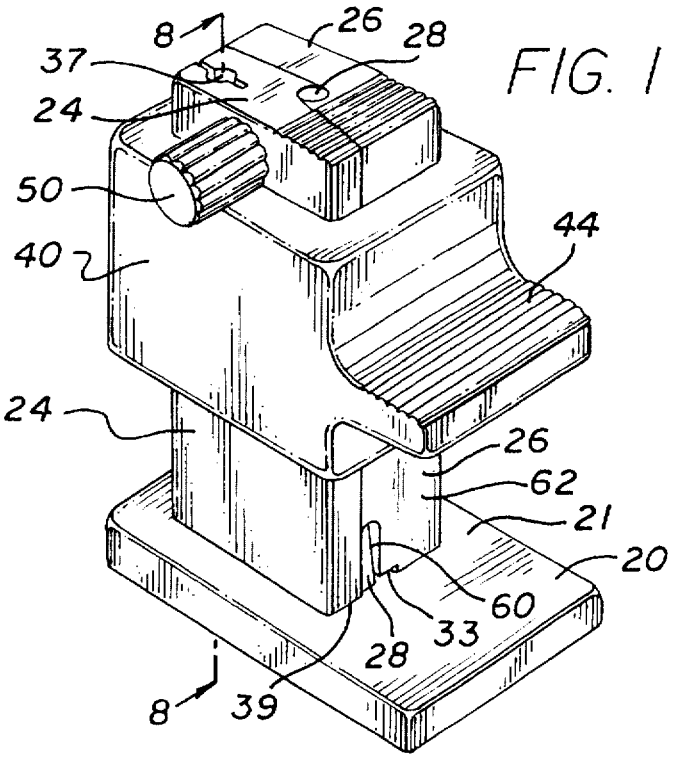
FIG. 1
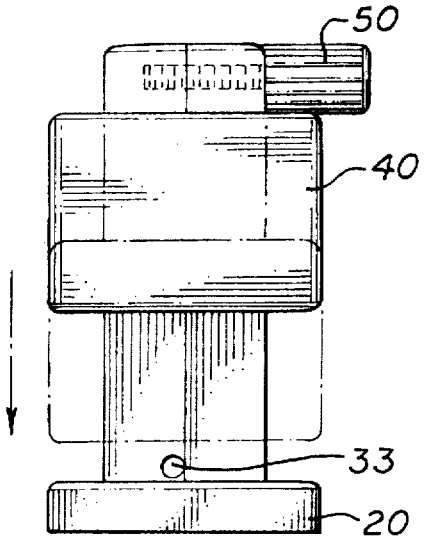
FIG. 2
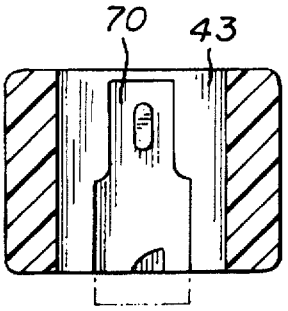
FIG. 4
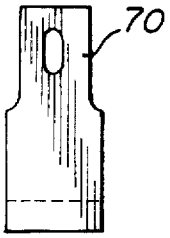
FIG. 5
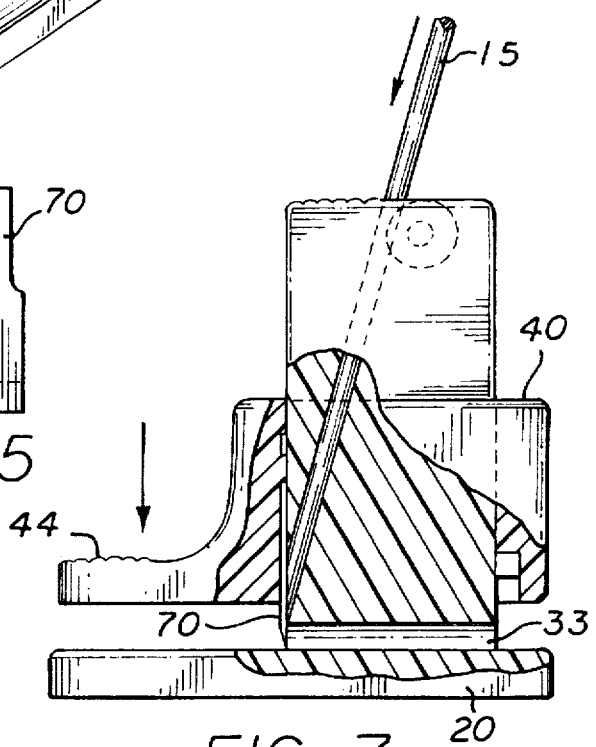
FIG. 7
FIG. 6
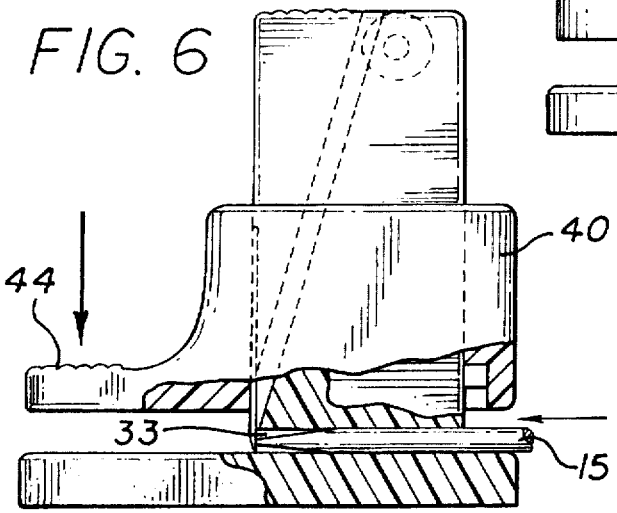
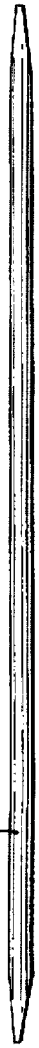
FIG. 11

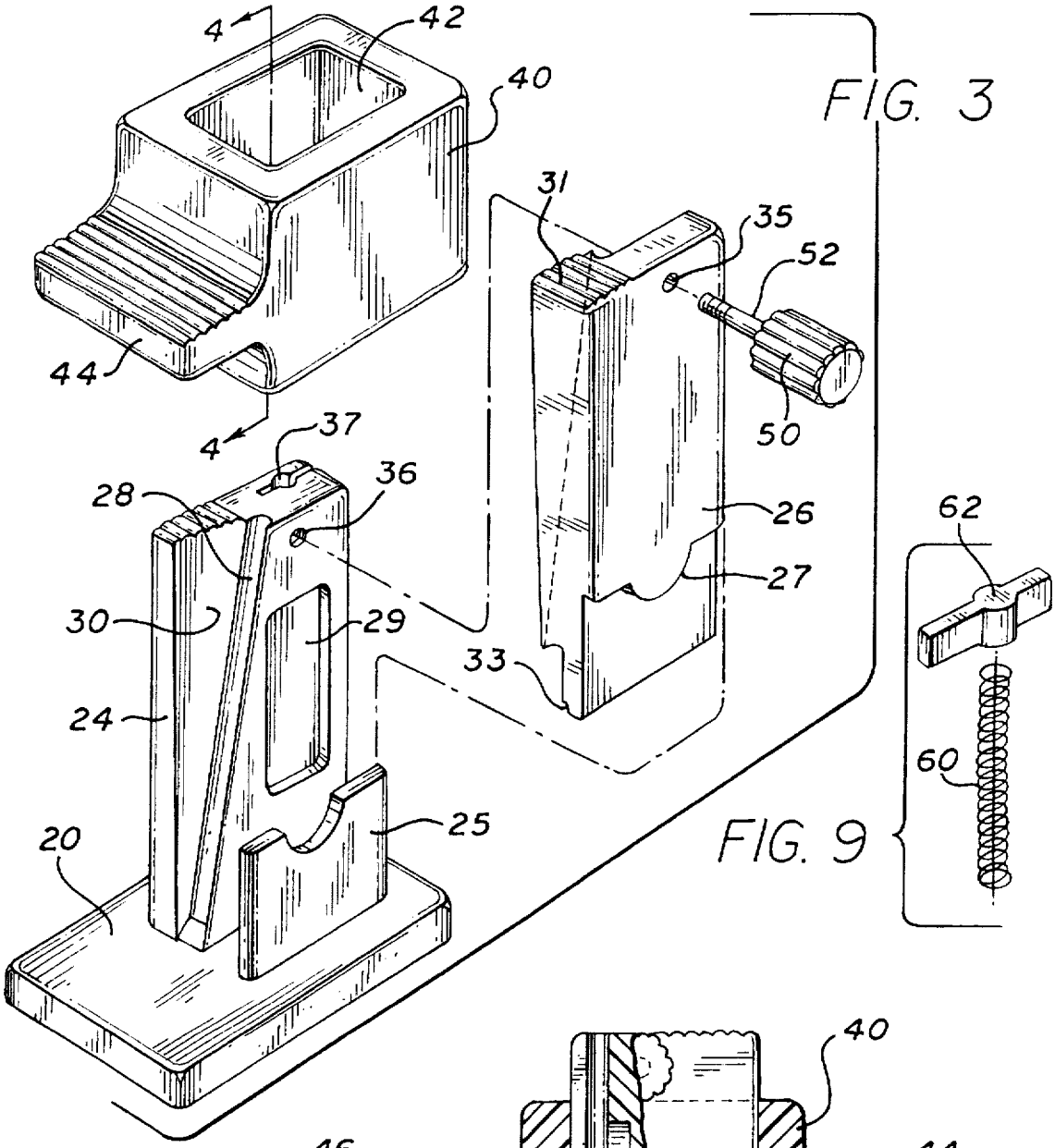
FIG. 3
FIG. 9
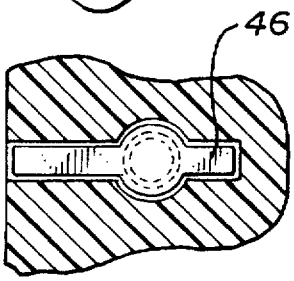
FIG. 10
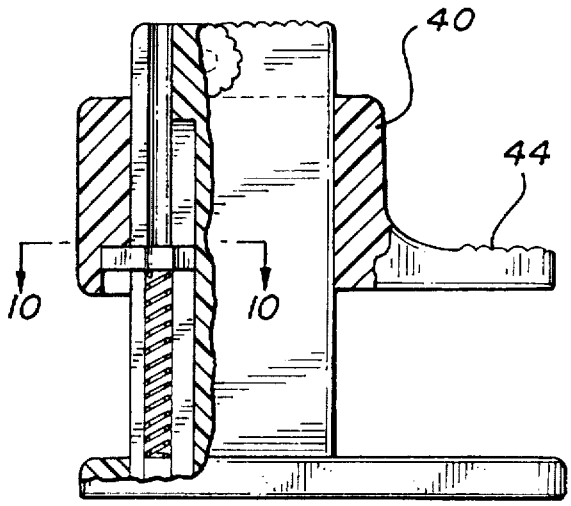
FIG. 8

NAIL STICK TRIMMER

FIELD OF THE INVENTION

The present invention relates to a device for trimming the ends of nail sticks, otherwise commonly referred to as orangewood sticks, in order to allow a nail technician or manicurist to reuse the nail stick after its use on a customer.

BACKGROUND OF THE INVENTION

Nail sticks, commonly referred to as orangewood sticks, wooden nail sticks, or cuticle sticks, are commonly used by nail technicians (manicurists) to push back the cuticle surrounding the nail so that the entire nail surface is exposed in preparation for application of nail polish. After nail polish has been applied to the nail, the nail stick is often used to remove any excess nail polish which may have inadvertently touched the skin. After its use in such an application, the nail stick is often left with an amount of nail polish adhering to the working surface at one end of the nail stick. Health regulations and concerns for avoiding contamination or infection of subsequent customers require that the nail stick be thrown away after its use on a single customer. Presently, a nail technician may use between one and three nail sticks per customer. Once the end of the nail stick has been stained, the nail technician flips the stick around and uses the opposite end. When that end is stained or damaged, the nail stick is thrown away. In any event, the nail technician cannot use the same nail stick on two different customers due to health regulations and risk of infection, as discussed above.

It is estimated that the average nail technician goes through approximately $350 worth of nail sticks per year. The device of the present invention provides a means for shaving off the used surfaces on the ends of the nail stick, in order to provide a clean and sanitary surface, thus enabling a nail technician to reuse the same stick over and over again. Thus, the useful life of the nail stick is extended by as much as ten times or more of the normal useful life, amounting to a savings of 1,000%.

SUMMARY OF THE INVENTION

A nail stick trimmer according to an embodiment of the present invention includes a base, a vertical tower, with a tower having a support portion fixed to the base and a separate clamping portion, the clamping portion being removably attached to the support portion. A surface of the support portion defines a recess having dimensions for cradling a nail stick against the support portion. The clamping portion mates with the support portion in order to hold the nail stick in the recess defined on a surface of the support portion. A threaded rod having a head portion at one end passes through a bore through the clamping portion and is threadedly engaged with a threaded bore and the support portion in order to secure the clamping portion in mating relationship with the support portion. A blade carrier is provided having a central bore therethrough with internal dimensions such that the blade carrier fits slidably over the outer periphery of the vertical tower formed by clamping the clamping portion to the support portion.

The blade carrier has a laterally extending flange portion that provides a surface for manual activation of the blade carrier from an upward resting position downwardly along the vertical tower towards the base. A blade is supported in a recess defined on the inner periphery of the bore through the blade carrier. Movement of the blade carrier along the vertical tower results in movement of the blade along a cutting plane. The cutting plane lies at an angle to the surface of the support portion that defines a recess for cradling the nail stick.

A nail stick is placed within the recess formed between the clamping portion and the support portion of the vertical tower with the used end of the nail stick extending across the cutting plane. Manual pressure is exerted against the laterally extending flange of the blade carrier in a downward direction to move the blade carrier along the vertical tower, thus moving the blade along the cutting plane and removing the used portion of the nail stick. Operation of the nail stick trimmer according to the procedure outlined above results in the creation of a beveled surface at the end of the nail stick extending across the cutting plane, with the beveled surface having an angle to the central axis of the nail stick being equal to the angle that the nail stick formed when supported in the vertical tower.

A second recess substantially parallel to the base of the nail trimmer is formed along a lower surface of at least one of the support portion and clamping portions of the vertical tower. The second recess is dimensioned so as to allow a nail stick to be supported in a horizontal position with a used end of the nail stick extending across the cutting plane. When a nail stick is supported in this second recess, downward force on the laterally depending flange of the blade carrier results in the blade removing the used end portion of the nail stick at an angle perpendicular to the central axis of the nail stick. A biasing means is provided for returning the blade carrier to its upward resting position after having been moved downwardly to remove a used end portion of a nail stick. The biasing means includes a spring supported within a vertical passage through the vertical tower and a spring cap provided over the top end of the spring and supported within a slot extending upwardly into the bottom surface of the blade carrier. Downward movement of the blade carrier along the vertical tower compresses the spring thus resulting in the storing of potential energy within the spring necessary to return the blade carrier to its upward resting position after it has removed a used end of the nail stick.

BRIEF DESCRIPTION OF THE DRAWINGS

For a fuller understanding of the nature of the present invention, reference should be had to the following detailed description taken in connection with the accompanying drawings in which:

FIG. 1 illustrates a perspective view of a nail trimmer according to an embodiment of the present invention;

FIG. 2 illustrates a rear elevation view of an embodiment of the present invention;

FIG. 3 illustrates an exploded perspective view of an embodiment of the present invention;

FIG. 4 is a cross-sectional view taken along line 4—4 in FIG. 3 showing a recess in the bore through the blade carrier for supporting a cutting blade;

FIG. 5 illustrates an elevation view of a blade;

FIG. 6 illustrates a side elevation view of an embodiment of the present invention with the blade carrier in a downward cutting position and a nail stick positioned within the horizontal recess through the vertical tower;

FIG. 7 illustrates a side elevation view with a blade carrier in a downward cutting position and a nail stick mounted within the angled recess through the vertical tower;

FIG. 8 illustrates a side elevation view of the present invention with the blade carrier in an upward resting position;

FIG. 9 illustrates the biasing means for the present invention comprising a spring and a spring cap;

FIG. 10 illustrates a bottom plan view of a portion of the blade carrier showing the slot for receiving the spring cap; and FIG. 11 illustrates a nail stick.

DETAILED DESCRIPTION OF THE PREFERRED EMBODIMENTS

Referring initially to FIG. 1, a perspective view of a nail stick trimmer according to the present invention is shown having a base portion 20 having a top surface 21 on a horizontal plane and a vertical tower mounted to the base portion that provides means for supporting a nail stick while a used end of the nail stick is removed. As shown in FIG. 3, the vertical tower includes a vertical support portion 24 and an alignment portion 25 fixed to base portion 20, and a separate clamping portion 26 that fits in between support portion 24 and alignment portion 25 and is configured to mate with support portion 24 along surface 31 of clamping portion 26 and surface 30 of support portion 24. A channel surface 28 extends from a top of support portion 24 to the base portion 20, at an angle less than 90° relative to the plane of the top surface 21 of base portion 20. The channel is provided with a semi-cylindrical contour dimensioned in order to cradle a nail stick 15, as shown in FIG. 11 so that the nail stick extends downwardly, at an angle, towards a bottom front edge 39 of support portion 24 and partially out through an opening 60 formed in a front face 62 of the vertical tower.

Clamping portion 26 is provided with a contoured outer surface 27 configured to mate with a corresponding surface on alignment portion 25 when clamping portion 26 is mated with support portion 24. When clamping portion 26 is mated with support portion 24, angled inner surface 31 of clamping portion 26 mates with angled inner surface 30 of support portion 24 thus capping off angled recess 28 to form an angled bore through the vertical tower for receipt of nail stick 15. As shown in FIGS. 1 and 3, a lower surface of clamping portion 26 also defines a recess 33 extending substantially parallel to the bottom edge of clamping portion 26. When clamping portion 26 is mated with support portion 24, recess 33 forms a second bore for supporting a nail stick 15 in a substantially horizontal position. Support portion 24 is also provided with vertical recesses 29 and 37, as best seen in FIG. 3, that provide clearance for a biasing means to be described later. A horizontal bore 35 through clamping portion 26 and a horizontal threaded bore 36 extending into support portion 24 are aligned when clamping portion 26 is mated with support portion 24 and are dimensioned to receive a threaded rod 52 after a blade carrier 40 is slid downwardly over the outer periphery of the vertical tower.

A blade carrier 40, as best seen in FIG. 3, is provided with a substantially vertical rectangular bore 42 therethrough dimensioned to fit slidably over the outer periphery of the vertical tower after clamping portion 26 is mated with support portion 24.

Referring to FIG. 4, a cross-sectional elevation view of blade carrier 40 is shown taken in the direction of arrows 4—4 in FIG. 3. A recess 43 is formed in one end wall of bore 42 and provides means for supporting a blade 70 flat against the end wall of the bore 42. As best seen in FIG. 7, when blade 70 is positioned within recess 43 of blade carrier 40, and blade carrier 40 is slid downwardly over the vertical tower formed by portions 24, 25 and 26, blade 70 travels along a substantially vertical cutting plane. The cutting plane extends in parallel, adjacent relation to front face 62 of the vertical tower, including opening 60 and horizontal recess 33. A nail stick 15 positioned within channel 28 at an angle alpha to vertical, is pushed downwardly through angled recess 28 until a used end of nail stick 15 protrudes from opening 60 and beyond the cutting plane. Downward movement of blade carrier 40 results in blade 70 trimming off the used portion of nail stick 15 at angle alpha, which is less than 90°, to the central axis of nail stick 15. Nail stick 15 can also be positioned within horizontal recess 33 such that the used portion of nail stick 15 extends outwardly from horizontal recess 33 on the front face 62 and beyond the cutting plane. Downward movement of blade retainer 40 results in cutting blade 70 removing the used portion of nail stick 15 at an angle substantially perpendicular to the central axis of nail stick 15.

Referring to FIGS. 8 and 9, a biasing means is provided for returning blade carrier 40 to an upward resting position after downward movement of blade carrier 40 results in blade 70 trimming off a used portion of nail stick 15. The biasing means includes a spring 60 and a spring cap 62. The spring 60 and spring cap 62 are retained within vertical recesses 29 and 37 of support portion 24, as shown in FIG. 3. Spring cap 62 is received within a slot 46 defined into the lower surface of blade carrier 40, as shown in FIG. 10. Downward movement of blade carrier 40 along the vertical tower formed by support portion 24, alignment portion 25, and clamping portion 26, results in compression of spring 60. Manual force to move blade carrier 40 downwardly along the vertical tower is exerted against a laterally extending flange 44 of blade carrier 40. The potential energy stored within spring 60 upon downward movement of blade carrier 40 is sufficient to return blade carrier 40 to its upward resting position after manual force is removed from laterally extending flange 44.

Referring to FIG. 3, assembly of the nail stick trimmer is achieved by clipping clamping portion 26 between alignment portion 25 and support portion 24 such that the contoured surface 27 of clamping portion 26 mates with a corresponding surface of alignment portion 25, and contoured surface 31 of clamping portion 26 mates with contoured surface 30 of support portion 24. Spring 60 and spring cap 62 are held in position within recesses 29 and 37 of support portion 24 while clamping portion 26 is moved into mating relationship with support portion 24. A blade 70 is mounted within recess 43 of blade carrier 40 and blade carrier 40 is then slipped downwardly over the outer periphery of the vertical tower formed by clamping portion 26 and support portion 24. After blade retainer 40 is slipped and moved part of the way down over the vertical tower, partially compressing spring 60, a threaded rod 52 with gripping head portion 50 is passed through bore 35 of clamping portion 26 and threadedly engaged with threaded bore 36 of support portion 24. Head portion 50 of threaded rod 52 is provided with an outer convoluted or knurled surface in order to provide easy gripping. After the vertical tower of the nail stick trimmer is formed by the assembly of support portion 24, alignment portion 25, and clamping portion 26, and blade carrier 40 is slipped over the vertical tower, threaded rod 52 is passed through bore 35 and engaged with threaded bore 36 in order to hold the clamping portion 26 to support portion 24 and also to prevent blade retainer 40 from being forced up off of the vertical tower by spring 60.

A nail stick 15 can be processed for reuse using the nail stick trimmer of the present invention by placing nail stick 15 downwardly through angled channel 28 until a used end portion of nail stick 15 protrudes through the opening 60 and beyond the cutting plane at the bottom end of the vertical tower.

While the instant invention has been shown and described in what is considered to be preferred and practical embodiments thereof, it is recognized that departures may be made within the spirit and scope of the present invention which, therefore, should not be limited except as set forth in the following claims and within the doctrine of equivalents.

Now that the invention has been described,

What is claimed is:

1. A device for trimming an end zone of a nail stick having a central longitudinal axis comprising:

a base portion including a top surface disposed in a horizontal plane;

a tower extending vertically upward from said top surface of said base portion and including a top end, opposite side faces, a rear face, a front face, and a bottom end adjacent said top surface of said base portion;

a first channel extending from an upper opening at said top end of said vertical tower to said top surface of said base portion and exiting said vertical tower at a lower opening formed in a lower portion of said front face of said tower, adjacent said bottom end, said first channel extending from said top end to said top surface of said base portion at an angle less than 90° and greater than 0° relative to said horizontal plane;

a second channel extending horizontally through a lower portion of said tower in horizontal, parallel relation to said top surface of said base portion, said second recess on said front face adjacent said bottom end;

a blade carrier slidably supported on said tower and including a blade supported thereon, said blade carrier being structured and disposed for reciprocating downward and upward movement on said tower to move said blade along a cutting plane parallel to said front face and adjacent to said lower opening and said recess of said first and second channels, respectively;

said first channel being structured and disposed for receipt of said nail stick therethrough so that said end zone of said nail stick extends from said lower opening and beyond said cutting plane with said central longitudinal axis disposed at an angle of less than 90° relative to said cutting plane; and said second channel being structured and disposed for receipt of said nail stick therethrough so that said end zone of said nail stick extends outwardly from said recess and beyond said cutting plane with said central longitudinal axis disposed at an angle perpendicular to said cutting plane.

2. A device as recited in claim 1 further including:

biasing means for urging said blade carrier upwardly on said tower to a resting position wherein said blade is above said lower opening and said recess of said first and second channels, respectively.

3. A device as recited in claim 2 wherein said tower comprises a support portion fixed to said base portion and a clamping portion, said clamping portion being separable from said support portion for disassembly of said device.

4. A device as recited in claim 3 wherein said blade carrier includes a laterally extending flange portion for manual actuation of said blade carrier to urge said blade carrier downwardly on said tower, against said biasing means, from said rest position to a cutting position wherein said blade is moved downwardly through said cutting plane to cut said end zone of said nail stick received in either of said first or second channels, respectively.

* * * * *